US011266221B2

(12) United States Patent
Berhault et al.

(10) Patent No.: US 11,266,221 B2
(45) Date of Patent: Mar. 8, 2022

(54) BRUSH FOR APPLYING A PRODUCT TO THE EYELASHES OR EYEBROWS

(71) Applicant: L'OREAL, Paris (FR)

(72) Inventors: Alain Berhault, Le Pre Saint Gervais (FR); Eric Caulier, Ferrieres (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 227 days.

(21) Appl. No.: 15/757,767

(22) PCT Filed: Sep. 2, 2016

(86) PCT No.: PCT/EP2016/070762
§ 371 (c)(1),
(2) Date: Mar. 6, 2018

(87) PCT Pub. No.: WO2017/042104
PCT Pub. Date: Mar. 16, 2017

(65) Prior Publication Data

US 2018/0344008 A1 Dec. 6, 2018

(30) Foreign Application Priority Data

Sep. 8, 2015 (FR) ..... 1558312

(51) Int. Cl.
*A45D 40/26* (2006.01)
*A45D 34/04* (2006.01)
(Continued)

(52) U.S. Cl.
CPC ..... *A45D 34/046* (2013.01); *A45D 34/043* (2013.01); *A46B 3/18* (2013.01);
(Continued)

(58) Field of Classification Search
CPC .. A45D 34/046; A45D 34/043; A45D 40/262; A45D 40/265; A46B 3/18;
(Continued)

(56) References Cited

U.S. PATENT DOCUMENTS 5,542,439 A * 8/1996 Gueret ..... A46B 3/18 132/218
2002/0020426 A1 2/2002 Gueret
2008/0060669 A1 3/2008 Malvar et al.

FOREIGN PATENT DOCUMENTS

EP 0 663 161 A1 7/1995
EP 0 832 580 A1 4/1998
(Continued)

OTHER PUBLICATIONS

Japanese Office Action dated Mar. 25, 2019 in Japanese Patent Application No. 2018-511018 (with unedited computer generated English translation), 11 pages.
(Continued)

*Primary Examiner* — Rachel R Steitz
(74) *Attorney, Agent, or Firm* — Oblon, McClelland, Maier & Neustadt, L.L.P.

(57) ABSTRACT

The present invention relates to a brush for applying a product to the eyelashes and/or eyebrows, that includes a core that extends along a longitudinal axis, and bristles held by the core, the core comprising a bristle-carrying portion with a proximal end, intended to be fixed to a stem, and a distal end, the bristles having free ends defining an envelope surface, the envelope surface having at least one cross section with a not entirely polygonal shape, the envelope surface defining at least one facet which extends longitudinally and is inclined with respect to the longitudinal axis of the core in the direction of the distal end, the facet having a width which increases in the direction towards the distal end
(Continued)

Figure 1:
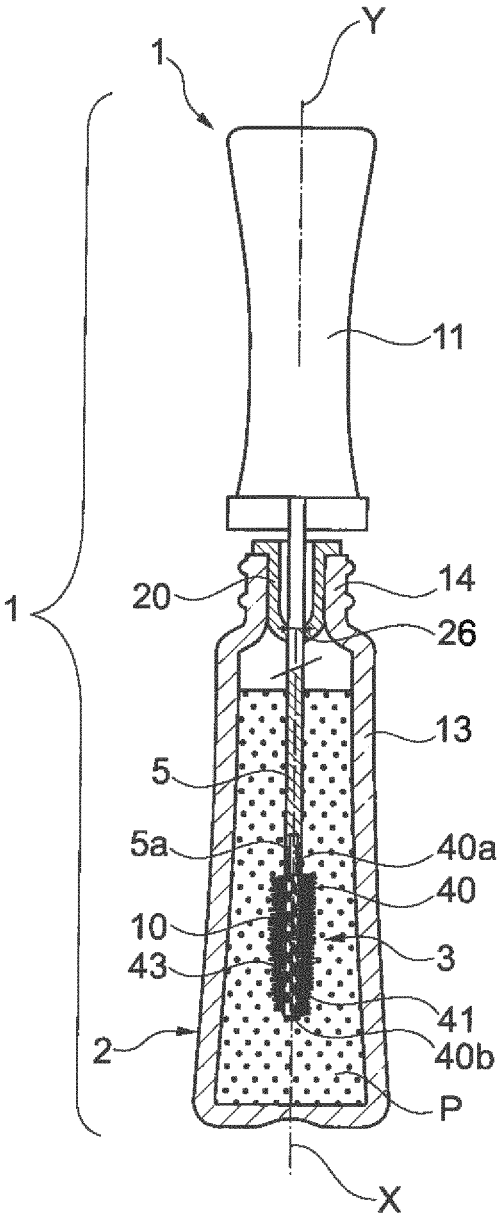

of the bristle-carrying portion of the core, over at least a portion of the length of the facet.

17 Claims, 4 Drawing Sheets

(51) Int. Cl.
*A46B 3/18* (2006.01)
*A46B 9/02* (2006.01)
*A46B 11/00* (2006.01)

(52) U.S. Cl.
CPC ..... *A46B 9/021* (2013.01); *A46B 11/00* (2013.01); *A46B 2200/106* (2013.01); *A46B 2200/1053* (2013.01)

(58) Field of Classification Search
CPC . A46B 9/021; A46B 11/00; A46B 2200/1053; A46B 2200/106
See application file for complete search history.

(56) References Cited

FOREIGN PATENT DOCUMENTS

| | | | |
|---|---|---|---|
| EP | 0 842 620 | A1 | 5/1998 |
| EP | 1 236 421 | A1 | 9/2002 |
| FR | 1187964 | A | 7/1998 |
| FR | 2 906 116 | A1 | 3/2008 |
| FR | 2 916 950 | A1 | 12/2008 |
| FR | 2 916 950 | B1 | 10/2010 |
| FR | 3 007 630 | A1 | 1/2015 |
| JP | 8-33518 | A | 2/1996 |
| JP | 10-113217 | A | 5/1998 |

OTHER PUBLICATIONS

International Search Report dated Nov. 10, 2016 in PCT/EP2016/070762 filed Sep. 2, 2016.
French Preliminary Search Report dated Jul. 15, 2016 in Patent Application No. 1558312 filed Sep. 8, 2015.
English translation of the Chinese Office Action dated Mar. 30, 2020 in Chinese Patent Application No. 201680052182.4, 9 pages.

* cited by examiner

BRUSH FOR APPLYING A PRODUCT TO THE EYELASHES OR EYEBROWS

The present invention relates to brushes for applying a cosmetic product to the eyelashes or eyebrows, in particular a makeup or care product, for example mascara, and to packaging and application devices comprising such a brush.

A large number of applicators, in which the brush comprises a core formed by two arms of a metal wire that are twisted together and grip bristles, are known. Since the bristles used are generally the same length, once the branches are twisted, the brush has an envelope surface in the form of a cylinder of revolution. Such a cylinder of revolution form has limited effectiveness in terms of loading the eyelashes with product and separation.

Efforts have thus been made to give the envelope surface more complex shapes so as to form on the brush, after wiping, zones that are more heavily laden with product, making it possible to properly load the eyelashes, and zones that are less heavily laden or are laden a little, these being usable to separate the eyelashes. Finding the shape that results in the optimum makeup result requires numerous tests, since many factors come into play.

In addition, it is economically advantageous for the brush to be able to be manufactured quickly and easily.

Numerous brushes have been proposed, with notches machined in the longitudinal direction of the core.

The patent application EP 1 236 421 discloses mascara brushes that can have facets which are substantially plane, parallel to the core and of a generally oval contour.

In the applications EP 0 832 580 and EP 0 842 620, the mascara brush is curved along its entire length, its free end being arranged on the longitudinal axis of the stem.

The application EP 0 663 161 relates to a mascara brush having a facet whose width varies from one end of the brush to the other and passes through an extreme between said ends, at a point of the core closer to the stem than the free end of the brush. The width of this facet decreases in the direction towards the free end of the brush.

The patent application FR 2 916 950 discloses a mascara brush with a polygonal cross section, over at least part of its length.

FR 3 007 630 discloses a mascara brush having facets which are arranged in such a way that the brush has hollows which alternate with reliefs around the core.

There is a need to improve the application of makeup along the entire row of eyelashes, in particular at the corner of the eye.

There is also a need to improve brushes, in particular to benefit from brushes that are capable of satisfactorily making up the eyelashes and eyebrows, by providing a sufficient load of product and satisfactory combing.

The invention aims to meet all or some of these needs and therefore according to one of its aspects, independently of or in combination with the above, relates to a brush for applying a product to the eyelashes and/or eyebrows, comprising:

- a core, in particular a twisted core, that extends along a longitudinal axis X, and
- bristles held by the core, the core comprising a bristle-carrying portion with a proximal end, intended to be fixed to a stem, and a distal end, the bristles having free ends defining an envelope surface, the envelope surface having at least one cross section with a not entirely polygonal shape, in particular with an at least partially circular shape, in particular with a circular shape, the envelope surface defining at least one facet which extends longitudinally and is inclined with respect to the longitudinal axis X of the core in the direction of the distal end, the facet having a width which increases in the direction towards the distal end of the bristle-carrying portion of the core, over at least a portion of the length of the facet.

A "facet" is understood as a cut in the envelope surface of the brush, preferably defined by a generatrix extending in a plane perpendicular to the longitudinal axis of the core and moving along a directrix, for example coplanar with the longitudinal axis of the core. A facet may be plane or non-plane, for example having a concave or convex curvature towards the outside. Such a curvature can depend on the shape of the generatrix, whether rectilinear or curved. Alternatively, the curvature of the facet can vary, for example being undulated.

"Inclined" is to be understood as meaning that a general direction of the facet forms an angle with the longitudinal axis of the core. The generatrix defining the corresponding facet can in particular move along a directrix not parallel to the longitudinal axis of the core, in particular rectilinear and forming an angle thereto, or curved.

The facet is inclined in the direction of the distal end of the core. This signifies that the inclination of the facet with respect to the longitudinal axis of the core is such that the facet approaches the longitudinal axis of the core in the direction towards the distal end of the brush. All of the facets of the brush can be inclined in the direction of the distal end. It is possible for the brush to have no facet inclined in the direction of the proximal end.

The brush according to the invention allows makeup to be applied with precision, in particular by virtue of the shape of its free end.

Finally, the brush according to the invention can provide satisfactory wiping as it passes through a wiping member of circular cross section.

The width l of the facet may increase along the entire length measured along the longitudinal axis of the core, or along only a portion thereof. The width l of the facet can increase along at least half of its length $L_2$, or at least ⅔ of its length $L_2$, preferably at least ¾ of its length $L_2$. The width l of the facet can increase and then decrease, then increase again, or else decrease and then increase, in the direction towards the distal end of the bristle-carrying portion of the core.

The widest part of the facet may be situated closer to the distal end than the proximal end of the bristle-carrying portion of the core, preferably at least a third or even at least a quarter of the length L of the bristle-carrying portion of the core, with respect to the distal end.

In an illustrative embodiment, the width l of the facet decreases in the direction towards the proximal end of the bristle-carrying portion of the core.

The facet may extend along the entire length L of the bristle-carrying portion of the core or else only part of said length, for example at least 50% of this length L, preferably at least 60%, or even at least 70%. The facet can extend along less than 95% of the length L of the bristle-carrying portion of the core, or along less than 90%, or even along less than 80%.

The facet may in particular extend as far as the distal end of the bristle-carrying portion of the core.

The facet may be delimited by an edge oriented perpendicularly with respect to the longitudinal axis of the stem at the distal end of the bristle-carrying portion of the core.

The presence of such an edge can improve the precision of application of the makeup and in particular can make it easier to make up the eye, in particular the corner of the eye, and even more particularly the inside corner of the eye.

The facet may be inclined with respect to the longitudinal axis of the stem by an angle α of between 5 and 35 degrees, preferably between 10 and 20 degrees. This signifies that the facet has a directrix D which is rectilinear and inclined by said angle α with respect to the longitudinal axis X of the stem. The facet is formed by the movement of a generatrix along this directrix D. For example, the generatrix can extend along the axis of rotation of a facet cutting tool, which can be of cylindrical shape and can move along the directrix D during the cutting.

The envelope surface may comprise a truncated portion with a cross section that decreases towards the free end of the core. The angle β of the cone with respect to the longitudinal axis X can have a value of between 5 and 35 degrees, preferably between 10 and 20 degrees. The angle β of the truncated portion with respect to the longitudinal axis X of the core can be less than the angle α of the facet with respect to the longitudinal axis X.

The envelope surface may have at least one cross section with a not entirely polygonal shape, in particular with an at least partially circular shape, in particular with a circular shape, situated at the proximal end. "At the proximal end" signifies that said at least one cross section is closer to the proximal end than the distal end of the bristle-carrying portion of the core, in other words less than ½ L from the proximal end of the bristle-carrying portion of the core of the core and more than ½ L from the distal end of the bristle-carrying portion of the core, where L is the length of the bristle-carrying portion of the core measured between its proximal end and its distal end. Said at least one cross section can be less than a third or even less than a quarter of the length L of the proximal end of the bristle-carrying portion of the core. In absolute terms, the length L can be between 15 mm and 45 mm, preferably between 20 mm and 40 mm, for example between 25 mm and 35 mm.

With a cross section of circular shape or at least partially circular shape, it is possible to obtain uniform wiping. The wiping can thus be greater at the proximal end of the bristle-carrying portion of the core.

The brush may be without a distal end in the shape of a tip. It can have a shape that is not entirely prismatic, at least at its distal end.

The circular cross section can be made at a point on the core that is situated less than ⅓ L from the proximal end of the bristle-carrying portion of the core and more that ⅔ L from the distal end of the bristle-carrying portion of the core. The circular cross section can be made at a point on the core that is situated less than ¼ L from the proximal end of the bristle-carrying portion of the core and more than ¾ L from the distal end of the bristle-carrying portion of the core.

The brush may be without a cross section of rectangular shape, in particular at its distal end.

The core may be curved. When the core is curved, it can be curved along the entire length of the bristle-carrying portion of the core. The curvature of the core can be constant or variable. The radius of curvature is, for example, between 20 and 60 mm. When the brush is curved, it can be more heavily laden in the hollow and better comb and separate on the convex side. The distal end of the core can be situated on the longitudinal axis Y of a stem to which the brush is attached.

In an alternative embodiment, the core is rectilinear. It may extend in the continuation of a longitudinal axis of a stem to which it is attached or can form an angle with the latter.

The brush may have several facets which extend longitudinally and are each inclined with respect to the longitudinal axis X of the stem, said facets having a width which increases in the direction towards the distal end of the bristle-carrying portion of the core. The facets can be distributed equally about the longitudinal axis X of the core. The envelope surface can have a plurality of facets, in particular between 3 and 6 facets, preferably 3 or 4 facets, preferably 3 facets.

The brush may have at least one cross section of a generally prismatic shape, this cross section being in particular situated near the distal end of the bristle-carrying portion of the core. The cross section of generally prismatic shape may be situated closer to the distal end than the proximal end of the bristle-carrying portion of the core, preferably at least a third or even at least a quarter of the length L of the bristle-carrying portion of the core, with respect to the distal end. The facet according to the invention may not cover the portion with the cross section of generally prismatic shape and may stop before said cross section of generally prismatic shape when moving along the longitudinal axis X of the core.

The brush may have a truncated portion at its proximal end, the truncated portion widening in the direction away from the proximal end of the bristle-carrying portion of the core. In one embodiment, the facet is without axial covering by the truncated portion. For example, the facet stops a little before or at the same level as the truncated portion.

The brush may be chamfered at its proximal and/or distal ends. In one embodiment, the brush is chamfered at its distal end and at its proximal end.

Facet By virtue of the facet(s), the brush according to the invention is in particular able to store product along the majority of its length so as to provide a supplementary load of product to the eyelashes and/or eyebrows.

The facet may have the following features, separately or in combination:

- a length $L_2$ with $L_2 \geq L/2$, where L is the length of the bristle-carrying portion of the core,
- a width l, constant along at least a portion of its length $L_2$, and
- a distance d from the longitudinal axis that varies along its length.

The constant width of the facet along a portion of its length makes manufacturing easier, since the facet can be hollowed out by a cutting tool moving along the longitudinal axis of the core, rotating on itself about an axis of rotation perpendicular to the longitudinal axis of the core.

The facet may be produced by moving a tool for cutting the bristles with a component parallel to the longitudinal axis of the core and a component perpendicular to the longitudinal axis of the core, the longitudinal movement making it possible to define the length $L_2$ of the facet and the perpendicular movement making it possible to define the distance d from the longitudinal axis. The cutting tool may have an axis of rotation perpendicular to the longitudinal axis of the core and parallel to the facet or, in a variant, perpendicular to the facet.

Preferably, the length $L_2$ of the facet is such that $L_2 \geq \frac{2}{3}L$. This makes it possible to have a facet which extends along a great majority of the length of the core carrying the bristles, thereby making it possible notably to obtain the desired effect on most of the eyelashes with minimum hand movements.

The distance d from the longitudinal axis, measured in a longitudinal mid-plane of the facet, may vary continuously along the length of the facet. The distance d from the longitudinal axis may change along a curve that does not have any angular points. This may make it possible to vary, in particular continuously, the quantity of product stored in the brush depending on the position along the longitudinal axis X.

The facet may have, in cross section, a flat bottom or a bottom that is convex towards the outside.

The shape of the bottom of the facet is defined entirely by the cutting tool. When the bottom is flat in cross section, the longitudinal axis of the cutting tool is preferably perpendicular to the bottom of the facet.

The width l of the facet may be between 1 mm and 4 mm, preferably between 1.5 mm and 3.5 mm.

The envelope surface, apart from the facets, may be cylindrical. The envelope surface, apart from the facets, may be a surface of revolution.

The envelope surface may be symmetrical with respect to the longitudinal axis X of the core. In a variant, the envelope surface does not exhibit axial symmetry.

The brush is fixed preferably by its proximal end to a stem.

Preferably, the core is a twisted core. The expression "twisted core" is to be understood as meaning a core formed by twisting two arms of a metal wire together in a conventional manner.

Device

A further subject of the invention is a packaging and application device having:

a container containing a product to be applied, a brush according to the invention.

The container may be provided with a wiping member for removing the excess product present on the stem and on the brush. This wiping member comprises, for example, a lip made of an elastomeric material, defining a wiping orifice of preferably circular section, the diameter of which corresponds substantially to that of the stem.

Manufacturing Method

A further subject of the invention is a method for manufacturing a brush according to the invention, comprising the steps of:

producing a brush blank having a rectilinear core, in particular a twisted core, cutting the bristles so as to obtain a brush according to the invention, in particular by moving a cutting tool both along an axis parallel to the longitudinal axis of the core and along an axis perpendicular to the longitudinal axis of the core, or by moving a cutting tool about an axis perpendicular to the longitudinal axis of the core, in particular an axis parallel to the facet.

The manufacturing method may comprise the step of curving the core once the facet has been machined.

The facet(s) may be formed by moving a cutting tool both along an axis parallel to the longitudinal axis of the core and along an axis perpendicular to the longitudinal axis of the core.

Alternatively or additionally, the facet(s) may be formed by moving a cutting tool about an axis perpendicular to the longitudinal axis of the core, in particular an axis parallel to the facet.

The cutting tool preferably has an axis of rotation parallel or perpendicular to the facet.

DETAILED DESCRIPTION

Figure 2:
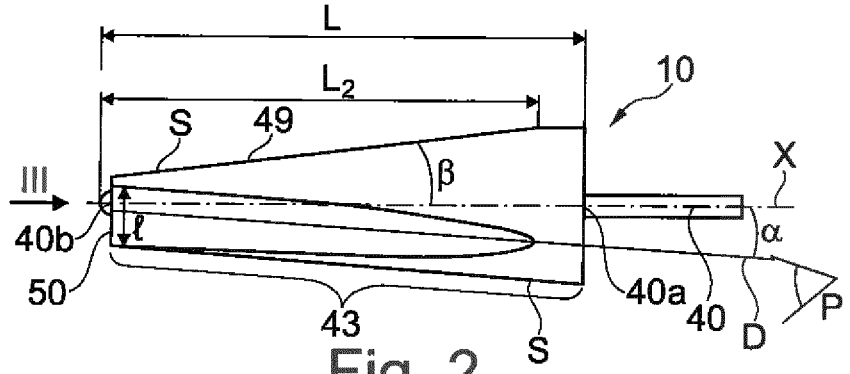
Figure 3:
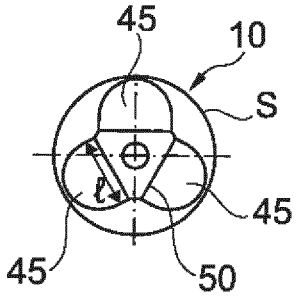
Figure 4:
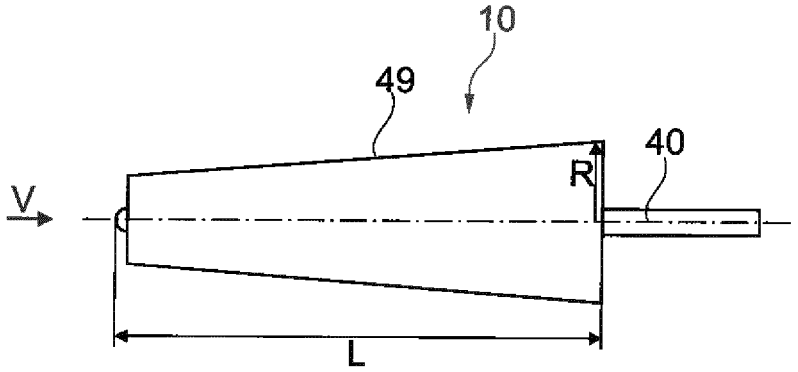
Figure 5:
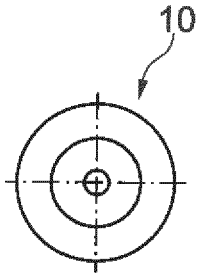
Figure 12:
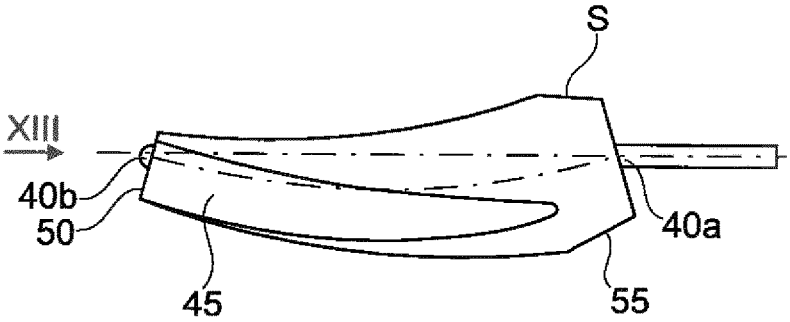
Figure 13:
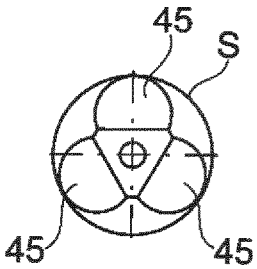
Figure 14:
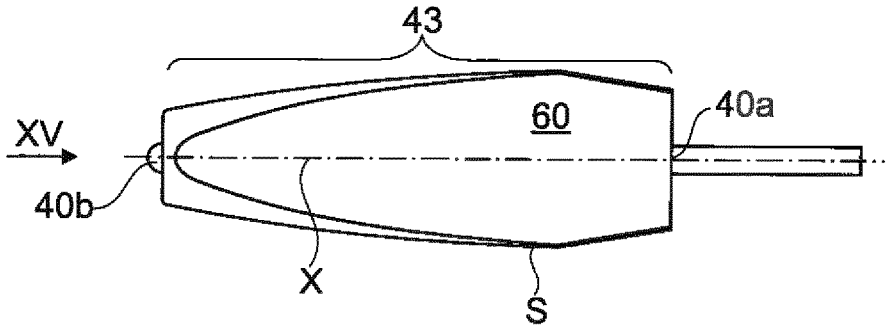
Figure 15:
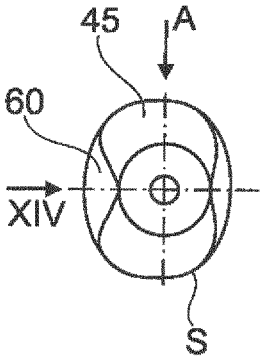
Figure 14A:
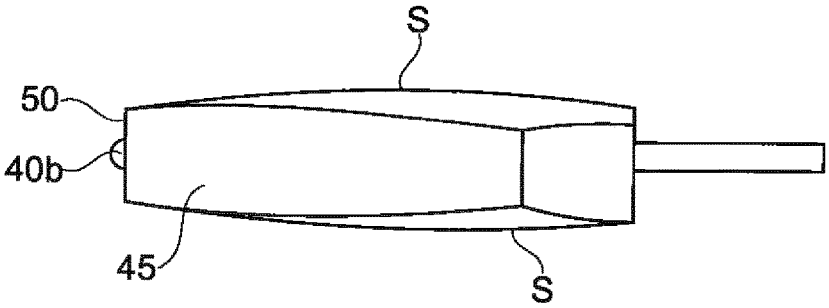
Figure 16:
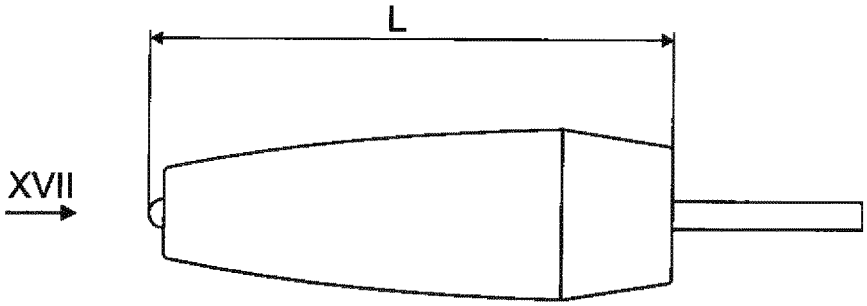
Figure 17:
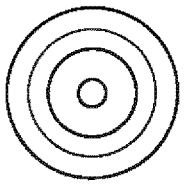
Figure 18:
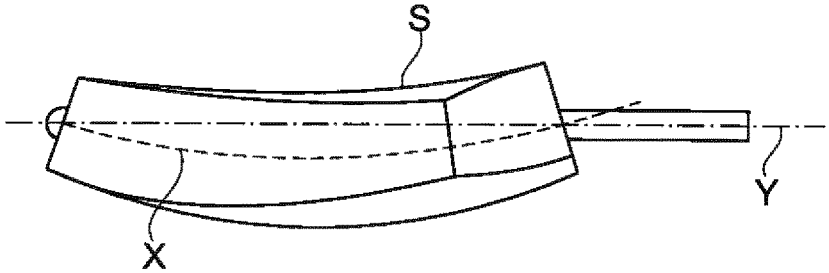

The invention may be better understood from reading the following detailed description of non-limiting illustrative embodiments thereof and from examining the appended drawing, in which:

FIG. 1 shows an example of a packaging and application device according to the invention, in schematic and partial longitudinal section, FIG. 2 is a side view of an example of a brush according to the invention, FIG. 3 is a view along the arrow III, FIGS. 4 and 5 are views, similar to FIGS. 2 and 3, of a blank for the brush from FIGS. 2 and 3, FIGS. 6 and 7 are views, similar to FIGS. 2 and 3, of an alternative embodiment, FIGS. 8 to 11 are views, similar to FIGS. 2 to 5, of an alternative embodiment, FIGS. 12 and 13 are views, similar to FIGS. 2 and 3, of an alternative embodiment, FIGS. 14 to 17 are views, similar to FIGS. 2 to 5, of an alternative embodiment, FIG. 14A is a view of the brush along the arrow A in FIGS. 14 and 15, FIG. 18 is a view, similar to FIG. 2, of an alternative brush according to the invention.

In the rest of the description, identical elements or elements having identical functions bear the same reference sign. Their description is not repeated for each of the figures, only the main differences between the embodiments being mentioned.

The packaging and application device 1 shown in FIG. 1 comprises a container 2 containing a product P to be applied to the eyelashes or eyebrows and an applicator 3 which can be fixed removably to the container 2 in the example in question. The product P comprises, for example, one or more pigments, in particular an iron oxide. It is, for example, a mascara.

The applicator 3 has a stem 5 of longitudinal axis Y, which stem is provided at a distal end 5*a* with a brush 10 according to the invention and is provided at the other end with a gripping member 11, which likewise forms a cap for closing the container 2 in a sealed manner. As can be seen in particular in FIG. 1, the latter comprises a body 13 which is provided at the top with a threaded neck 14 onto which the gripping member 11 can be screwed in order to close the container 2 in a sealed manner. In a variant, the applicator can be fixed to the container in some other way.

The neck 14 may accommodate, as illustrated, a wiping member 20 which is, for example, inserted into the neck 14. This wiping member 20 comprises a lip 26 that defines a wiping orifice having a diameter adapted to that of the stem 5.

The brush 10 can be fixed, in a conventional manner, in a seat provided at the distal end 5*a* of the stem 5, which is advantageously made of a thermoplastic material. The brush 10 has a twisted metal core 40 having a portion 43 carrying bristles 41. The core is fixed at a proximal end 40*a* in the corresponding seat of the stem 5 by a portion that does not have bristles, it being possible for said portion to have a length of the order of 8 mm. The bristle-carrying portion 43 of the core has a free end 40*b*.

As is illustrated in FIG. 2, the free ends of the bristles 41 define an envelope surface S of the brush 10. As is illustrated in FIG. 2, the bristles 41 extend along a length L of the core of preferably between 25 mm and 35 mm, for example equal to 30 mm.

The core 40 is formed conventionally by two arms of a metal wire folded in a U-shape, the bristles 41 being held between the turns of the core 40. The diameter of the metal wire is, for example, between 0.1 and 1 mm. The diameter of the bristles is, for example, between 0.06 and 0.35 mm.

The envelope surface S has at least one cross section of circular shape. In the example described, this circular cross section is situated near the proximal end 40*a*.

Moreover, as is illustrated in FIGS. 2 and 3, the envelope surface S has three facets 45 extending longitudinally and being inclined with respect to the longitudinal axis X of the core 40. In the example described, the facets 45 are plane and each extend in a plane P forming an angle $\alpha$ with the longitudinal axis X of the core. Each facet has a directrix D which is rectilinear and inclined by said angle $\alpha$ with respect to the longitudinal axis X of the stem. The angle $\alpha$ is, for example, between 5° and 35°.

The three facets are preferably distributed equally about the longitudinal axis X of the core, as illustrated. Each facet 45 extends along a length $L_2$ which corresponds to approximately 90% of the length L of the bristle-carrying portion 43 of the core.

The facets 45 have a width l which increases in the direction towards the distal end 40*b* of the bristle-carrying portion 43 of the core.

The width l of each facet can increase along the entire length $L_2$ of the facet, measured along the longitudinal axis X of the core, or along only a portion thereof. The width l of the facet can increase and then decrease, then increase again, or else decrease and then increase, in the direction towards the distal end of the bristle-carrying portion of the core.

In the illustrative embodiment shown in FIGS. 2 and 3, the width l of the facet decreases in the direction towards the proximal end 40*a* of the bristle-carrying portion of the core, along the entire length $L_2$ of the facet 45. In addition, the width reaches its maximum at the distal end 40*b*.

The facets 45 is thus delimited in part by an edge 50 perpendicular to the longitudinal axis X of the core and situated at the distal end 40*b*. In the example described, the facets are not contiguous at their distal end. The cross section of the brush is of substantially triangular shape at the distal end of the brush.

The envelope surface S has a truncated portion 49 with a cross section that decreases in the direction towards the free end 40*b* of the core. The angle $\beta$ of the cone with respect to the longitudinal axis X can have a value of the order of 15°. This angle $\beta$ is less than the angle $\alpha$ of the facet 45 with respect to the longitudinal axis X. The cross section of the brush is of circular shape at the proximal end of the brush.

FIGS. 4 and 5 illustrate a brush blank in which the aforementioned truncated portion 49 is produced before the formation of the facets 45. It will thus be seen that the envelope surface S, apart from the facets 45, has substantially the shape of a cylinder of revolution. The maximum radius R of the envelope surface S, corresponding to the radius of the smallest cylinder of revolution in which the brush is inscribed, is between 3 mm and 6 mm, for example 4.5 mm.

In the alternative embodiment illustrated in FIGS. 2 and 3, the core 40 is rectilinear. It extends in the continuation of the longitudinal axis Y of the stem to which it is attached.

Figure 6:
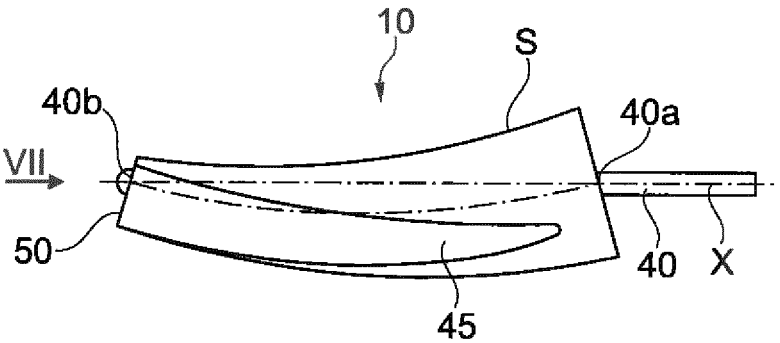
Figure 7:
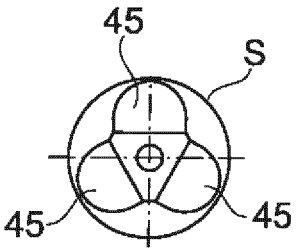
Figure 8:
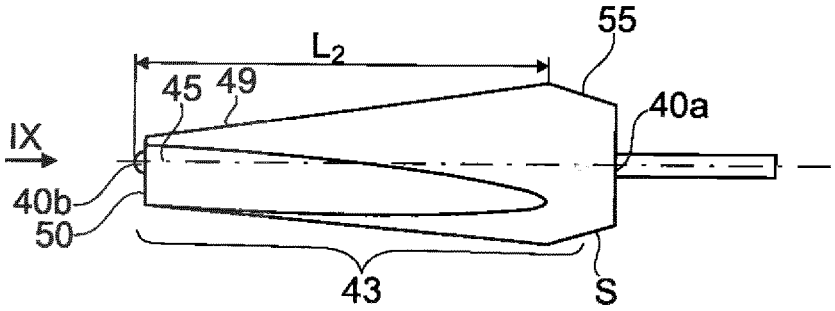
Figure 9:
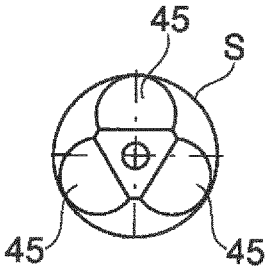
Figure 10:
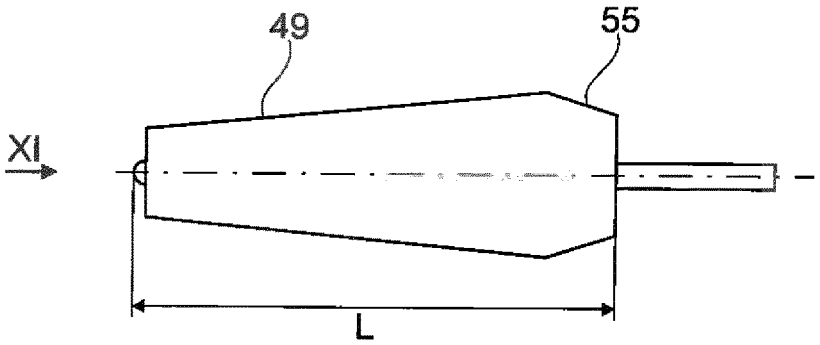
Figure 11:
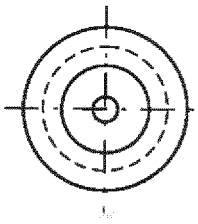

In the alternative embodiment illustrated in FIGS. 6 and 7, the core is curved. It is curved in a plane Q which, in the example described, is a plane containing the longitudinal axis X and perpendicular to one of the facets. This plane Q is a plane of symmetry for the brush. The brush is curved along the entire length of the portion 43, and the distal end 40*b* of the core is situated on the longitudinal axis X and also on the longitudinal axis Y of the stem.

The alternative embodiments illustrated in FIGS. 8 to 12 differ from those illustrated in FIGS. 2 to 7 in terms of the presence of a truncated portion 55 near the proximal end 40*a* of the bristle-carrying portion 43. This truncated portion widens in the direction away from the proximal end 40*a*.

The facet 45 stops a little before or at the same level as the truncated portion, near the proximal end.

The alternative embodiments illustrated in FIGS. 14 to 18 differ from the preceding ones in terms of the presence of two diametrically opposite facets 45, and one facet 60 situated at 45° from the facets 45 with respect to the longitudinal axis X. The facet 60 does not have a width increasing in the direction towards the distal end 40*b* of the bristle-carrying portion 43 of the core. On the contrary, the width of the facet 60 decreases in the direction towards the distal end 40*b* of the bristle-carrying portion of the core. The cross section of the distal end 40*b* is flattened on one side at least on account of the facet 45.

Generally, the envelope surface can comprise a different number of facets, and it is possible for the latter not to be identical to one another and/or not to be distributed evenly around the core 40.

In addition, the brush in FIGS. 14 to 15 has a general shape which, apart from the facets 45 and 60, has a convex profile. It will be seen that the blank for this brush has an ogival shape before the formation of the facets, which is illustrated in FIGS. 16 and 17.

The ends 52 of the envelope surface S can be chamfered. This can make it easier for the brush 3 to pass through the wiping member 20. The chamfer at the distal end and the chamfer at the proximal end can be different. The chamfer at the distal end can in particular be less inclined than that at the proximal end.

The invention is not limited to the illustrative embodiments which have just been described, the characteristics of which may be combined with one another as parts of variants which are not illustrated.

The expression "comprising a" is to be understood as being synonymous with "comprising at least one".

The invention claimed is:

1. A brush for applying a product to the eyelashes and/or eyebrows, comprising:

a core, that extends along a longitudinal axis; and bristles held by the core, the core comprising a bristle-carrying portion with a proximal end, intended to be fixed to a stem, and a distal end, the bristles having free ends defining an envelope surface, the envelope surface having at least one cross section having curved and straight portions or with an at least partially circular shape, the envelope surface defining several facets which extend longitudinally and are inclined with respect to the longitudinal axis of the core in the direction of the distal end, each facet having a width which increases in the direction towards the distal end of the bristle-carrying portion of the core, over at least a portion of the length of the facet, each facet being delimited by an edge oriented perpendicularly with respect to the longitudinal axis of the core at the distal free end of the bristle-carrying portion of the core, and a widest part of each facet being situated at the distal end of the bristle-carrying portion of the core.

2. The brush according to claim 1, wherein each facet is delimited by an edge oriented perpendicularly with respect to the longitudinal axis of the stem at the distal end of the bristle-carrying portion of the core.

3. The brush according to claim 1, wherein the width of each facet decreases in the direction towards the proximal end of the bristle-carrying portion of the core.

4. The brush according to claim 1, wherein each facet is inclined with respect to the longitudinal axis of the stem by an angle $\alpha$ of between 5 and 35 degrees.

5. The brush according to claim 1, wherein the envelope surface has a truncated portion with a cross section that decreases towards the free end of the core.

6. The brush according to claim 5, wherein an angle $\beta$ of the truncated portion with respect to the longitudinal axis of the core is less than an angle $\alpha$ of the at least one facet with respect to the longitudinal axis.

7. The brush according to claim 1, wherein the envelope surface has at least one cross section of circular shape situated at the proximal end.

8. The brush according to claim 1, wherein the core is curved.

9. The brush according to claim 8, wherein the distal end of the core is situated on the longitudinal axis of a stem to which it is attached.

10. The brush according to claim 1, wherein the several facets extend longitudinally and are each inclined with respect to the longitudinal axis of the stem, said facets having a width which increases in the direction towards the distal end of the bristle-carrying portion of the core.

11. The brush according to claim 10, wherein the facets are distributed equally about the longitudinal axis of the core.

12. The brush according to claim 1, having at least one cross section of a generally prismatic shape.

13. The brush according claim 1, having a truncated portion near its proximal end, the truncated portion being oriented such that it widens in the direction away from the proximal end of the bristle-carrying portion of the core.

14. The brush according to claim 13, wherein each facet is not superposed with the truncated portion.

15. The brush according to claim 1, wherein the core is fixed by its proximal end to a stem.

16. A packaging and application device comprising a container containing a product to be applied and the brush according to claim 1.

17. A brush for applying a product to the eyelashes and/or eyebrows, comprising:

a core, that extends along a longitudinal axis; and bristles held by the core, the core comprising a bristle-carrying portion with a proximal end, intended to be fixed to a stem, and a distal end, the bristles having free ends defining an envelope surface, the envelope surface having at least one cross section having cured and straight portions or with an at least partially circular shape, the envelope surface defining several facets which extend longitudinally and are inclined with respect to the longitudinal axis of the core in the direction of the distal end, each facet having a width which increases in the direction towards the distal free end of the bristle-carrying portion of the core, over at least a portion of the length of the facet, each facet extending in a plane, a widest part of each facet being situated closer to the distal end than the proximal end of the bristle-carrying portion of the core, the facets being not contiguous at their distal end.

* * * * *